US005255151A

United States Patent [19]

Cai et al.

[11] Patent Number: 5,255,151

[45] Date of Patent: Oct. 19, 1993

[54] ELECTROMAGNET WITH MOMENTARY DEMAGNETIZATION

[75] Inventors: Lijun Cai, No. 144, Unit 91, Beijing Institute of Technology, Beijing 100081, PRC; Jingling Deng, Beijing; Xueming Wang, Beijing; Fuzhen Shen, Beijing, all of China

[73] Assignee: Lijun Cai, Beijing, China

[21] Appl. No.: 774,573

[22] Filed: Oct. 10, 1991

[30] Foreign Application Priority Data

| | | | |
|---|---|---|---|
| Oct. 22, 1990 | [CN] | China | 90108316.X |
| Nov. 15, 1990 | [CN] | China | 90109015.8 |
| Nov. 15, 1990 | [CN] | China | 90223472.2 |
| Jul. 23, 1991 | [CN] | China | 91104978.9 |

[51] Int. Cl.[5] ..... H01F 7/08

[52] U.S. Cl. ..... 361/154; 335/262

[58] Field of Search ..... 361/154; 335/260, 262, 335/258, 278, 244

[56] References Cited

U.S. PATENT DOCUMENTS

| | | | |
|---|---|---|---|
| 4,409,580 | 10/1983 | Ishigaki | 335/242 |
| 4,476,451 | 10/1984 | Kosugi | 335/262 |

FOREIGN PATENT DOCUMENTS

| | | |
|---|---|---|
| 86206031 | 10/1987 | China . |
| 1038543 | 1/1990 | China . |
| 2056789 | 5/1990 | China . |
| 2062900 | 9/1990 | China . |
| 0300407 | 1/1989 | European Pat. Off. . |
| 55-44723 | 3/1980 | Japan . |
| 56-107546 | 8/1981 | Japan . |
| 57-96510 | 6/1982 | Japan . |
| 57-208114 | 12/1982 | Japan . |
| 59-5604 | 1/1984 | Japan . |
| 59-33805 | 2/1984 | Japan . |
| 59-158266 | 9/1984 | Japan . |
| 59-175709 | 10/1984 | Japan . |

OTHER PUBLICATIONS

"DC Operation for AC Contactor With Transformer", Zhou Jiwen, No. 4/1983, pp. 26–27.

"Changing AC Braking Electromagnet to DC Operating", Song Tian-eng, No. 2/1985 p. 16.

"Energy Saving Technology for AC Contactor", Liu Bingzhang, No. 2/1989, pp. 25–28.

*Primary Examiner*—A. D. Pellinen
*Assistant Examiner*—Aditya Krishnan
*Attorney, Agent, or Firm*—Ladas & Parry

[57] ABSTRACT

An energy saving electromagnet with momentary demagnetization of this invention comprises an armature, an iron core, an exciting coil, and a controllable power source. It is provided with an energy storage means capable of generating a momentary rotation force to cause the armature to rotate slightly for momentary demagnetization after the power source is cut off. The controllable power source includes an initiation power source, a holding power source and a control circuit for turning the supply from the initiation source to the holding source, thereby enabling effective utilization of the electric power and reduction of magnetic resistance. In the holding state, there is no significant demagnetizing air gap between the armature and the iron core.

28 Claims, 8 Drawing Sheets

ELECTROMAGNET WITH MOMENTARY DEMAGNETIZATION

This invention relates to an electromagnet, particularly relates to an energy saving electromagnet of high response initiation and speed adjustability, which employs momentary demagnetization structure without demagnetizing air gap.

BACKGROUND OF THE INVENTION

As known by the public, the electromagnet is a low-voltage electric apparatus for converting electrical energy to mechanical energy, and is widely applied in industrial fields and various products. When the exciting coil of its excitation system is powered to form a magnetic field incorporating with the iron core, the magnetic field attraction force attracts the armature with mechanical load towards the coil and the iron core so that the electromagnet starts to work. When the armature stops moving and turns to the holding state, the effect of the current is only to maintain the rated holding force between the iron core and the armature.

The conventional electromagnets can be divided into two kinds, i.e., AC and DC. Based on the principle of constant magnetic flux linkage, the AC electromagnet has the advantages of increasing automatically the initiating power and decreasing automatically the holding power. Therefore, it has attained very wide applications in industries. However, the AC electromagnet has the disadvantages of extremely low power factor, iron loss (eddy-current and magnetic hysteresis loss), magnetic separation ring loss, pulsing force loss, hum noise, and burning of the coil due to the armature overload. Based on the principle of constant magnetic potential, the DC electromagnet has the advantages of high power factor (without any back electromotive force in holding state), no iron loss in the holding state, no magnetic separation ring, no noise, no burning of the coil due to armature overload. The DC electromagnet, however, has the disadvantages of a very steep characteristic curve of attraction force, and is incapable of increasing automatically the initiation power and decreasing automatically the holding power. It can only be used in operating modes of very low initiation load and very short working stroke. Thus, its applications are far less than that of the AC electromagnets.

In order to overcome the disadvantages of both AC and DC electromagnets and combine the advantages of both, the variable magnetic potential DC electromagnet technology has been proposed. There are two approaches for this technology, one is the double coil approach and the other is the double power source approach.

A double exciting coil technical approach was disclosed by Japanese patent laid open bulletin 59-175709 on Oct. 4, 1984, wherein the holding coil is shorted out by the normal close contacts at the DC initiation of the electromagnet, and the initiation coil and the holding coil are connected in series by the separation of the normal close contacts at the termination of initiation, thereby turning into the holding state. Obviously, a higher initiation current can be obtained when the initiation coil works individually, and a lower holding current can be obtained when the two coils work in series. Although this approach that has the advantages of both AC and DC electromagnets has overcome partially the disadvantages of the DC electromagnet, and has widened its application scope, as well as is energy saving, there are still some disadvantages, such as the complicated production process of the double coil, the waste of copper material, the limit of the holding current due to the use of the same voltage power source, the generation of electric arc at the separation of the mechanical contacts, and the burning of the coil due to a false separation of the contacts.

The double power source approach may compensate the disadvantages of the double coil approach. The double power source approach uses only a single exciting coil, while it is powered separately by two DC sources at initiation and in holding state. This brings a great convenience to the high magnetic potential initiation and low magnetic potential holding, since the voltage difference between the two sources could be very large. This approach has been disclosed in an article of "Changing AC braking electromagnet to DC operating" in a Chinese publication "Low Voltage Apparatus" vol. II, 1985 and a Chinese patent application (publication No. CN1038543A). The disadvantages of the above mentioned references are: not only the AC component of one-half period rectification or one-half period conduction through phase shift at its initiation is large, but also the high response initiation and large stroke operation cannot be achieved due to the limited raising of the magnetic potential at the initiation. It is likely to cause mechanical impact at the instant of attracting together, since the electromagnet is continuously powered by the initiation power source in the whole procedure of the movement of the armature; the thyristor as a one-half period rectification device for the initiation power source in the above mentioned article of "Low Voltage Apparatus" is triggered in the manner of unidirectional voltage bypass triggering, which is seriously affected by the phase at the instant of closing the power supply switch of the electromagnet for initiation. Thus, the initiation time may be delayed. The problem of delayed initiation time also exists in the above mentioned Chinese patent application when the voltage at the instant of closing the switch is in the negative half period.

In addition, the holding power source commonly adopts transformer and capacitor for voltage reduction in the double power source energy saving technique of the existing electromagnets. Since the non-load current of the transformer and the exciting current are of the same magnitude for medium and small holding force electromagnets, the voltage reduction by the transformer is only appropriate to the electromagnets of large holding force, while the voltage reduction by the capacitor is only appropriate to the small holding force electromagnets. The sizes of the transformers and capacitors are too bulky when they are used for the large and medium holding force electromagnets, that is to say, the existing double power source techniques are difficult to satisfy the requirements of different loads. Further, the voltage reduction by the transformer and capacitor has the drawback of being difficult to be modularized.

The variable magnetic potential DC electromagnet saves energy mainly by improving its power factor, i.e., by reducing reactive power loss. As proved by experiments, the demagnetizing air gap kept by the existing electromagnets consumes approximately 60%-95% of the active power of the electromagnets. Therefore, the advantage of energy saving by providing extremely low holding voltage of the double power source cannot be exploited sufficiently, if the mechanical structure of the electromagnet per se cannot reduce the active power loss efficiently. In addition, since the holding force between the iron core and the armature is reduced by the high magnetic resistance produced by the demagnetizing air gap, the coil, iron core, and armature have to be designed to be bulky in order to maintain their rated holding force, thereby resulting in the waste of large amounts of copper and iron materials.

SUMMARY OF THE INVENTION

The object of the present invention is to provide an electromagnet, the electromechanical combination of which can significantly reduce the active and reactive power consumption.

Another object of the present invention is to provide an electromagnet having higher real-time characteristic, fast response and adjustability of initiation speed.

The third object of the present invention is to provide an electromagnet operative to reduce the impact of the armature against the iron core as well as to improve the reliability of controlling the initiation power source.

The fourth object of the present invention is to provide an electromagnet operative to widely satisfy the requirements of various working strokes and loads.

The final object of the present invention is to provide an electromagnet with significantly reduced size, material saving, and lower cost.

The electromagnet of this invention comprises an electromagnetic body including an armature and an iron core and a DC excitation system including an exciting coil and a controllable power source means. There is no demagnetizing air gap between the armature and the iron core in the holding state (there exists only unavoidable processing air gap in the production and assembly).

An energy storage means is applied to the electromagnetic body. The energy storage means is stored with mechanical energy in the holding state of the electromagnet, which forms an action force on the iron core from the armature as well as a reaction force on the armature from the iron core. The action line of the resultant of the reaction force is non-collinear with the action line of the resultant of the holding force thereby generating a momentary rotation force on the armature so as to cause the armature to make a slight rotation permissible by the structure of the electromagnetic body relative to the iron core after the exciting coil is de-electrified. The energy storage means may be the reset means of the armature in a loading system.

The controllable power source means comprises an initiation power source and a holding power source of different voltages, and a control switch for real-time turning on the initiation power source and converting the initiation power source to the holding power source. The initiation power source and holding power source employ full bridge rectification to energize the exciting coil. The electromagnet according to the present invention has the advantages of fast response initiation, adjustability of initiation speed, energy saving, material saving and long working life. Experiments show that it saves 95%–99.5% of energy, 40%–80% of material, as well as prolongs working life by 5–10 times and reduces cost by 30%–70%.

BRIEF DESCRIPTION OF THE ACCOMPANYING DRAWINGS

DETAILED DESCRIPTION OF THE INVENTION

Figure 1:
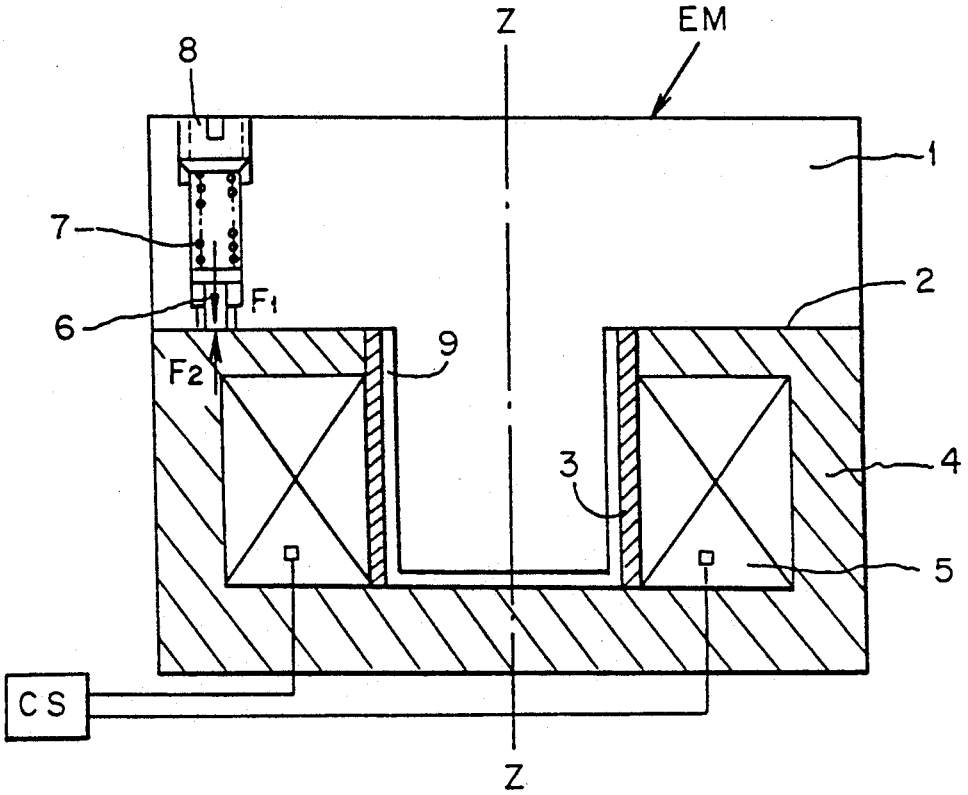
FIGS. 1 and 2 are the cross sectional views of the first and second embodiments according to the present invention respectively illustrating an electromagnet body having momentary demagnetization structure without demagnetizing air gap.

Referring to FIG. 1 showing the first embodiment, wherein an armature 1 moves in an iron core 4 guided by a guide sleeve 3. There is a clearance 9 between the guide sleeve 3 and the guide post of the armature, permitting the armature 1 to rotate slightly relative to the iron core 4. The energy storage means is a spring energy storage means disposed on the armature 1. The energy storage means comprises a spring 7, an adjusting screw 8 and a ball 6. When the electromagnet EM is in the holding state, the ball 6 applies an action force F1 on the iron core 4 acted by the spring 7. Thus, the iron core 4 applies a reaction force on the armature 1 through the above mentioned spring energy storage means. The action line of the resultant force F2 (the straight line with an arrow showing the resultant force F2) is non-collinear with the action line Z of the resultant of the holding force. Therefore, the force F2 generates a momentary rotation force on the armature 1, which causes the armature 1 to make a slight rotation relative to the iron core 4 after the exciting coil is de-electrified. The magnitude of the above mentioned momentary rotation force can be adjusted through the adjusting screw 8. The spring energy storage means may also be disposed on the iron core 4. There is a controllable power source means CS to energize the exciting coil.

Figure 2:
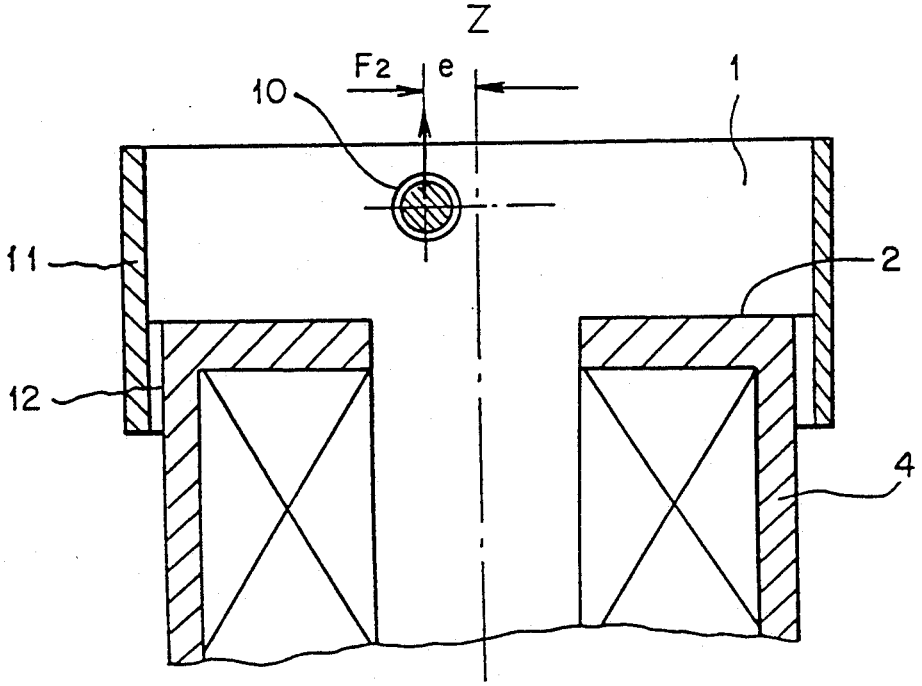

In FIG. 2 showing the second embodiment, the action force F2 on the armature 1 by the reset means of the armature 1 in a loading system (not shown) is acted on a cylindrical pin 10 having a bias e from the action line Z of the resultant of the holding force. The momentary rotation force formed by the pulling force F2 on the armature 1 causes the armature to make a slight rotation relative to the iron core 4, after the exciting coil 5 is de-electrified.

In order to protect the holding surface 2 from pollution by dust and dirt, a protecting cover 11 is provided in the present embodiment. The effective length of the dirt protecting cover 11 is longer than the stroke of the armature 1, and there is a clearance 12 between the protecting cover 11 and the iron core 4, permitting the armature 1 to make a slight rotation.

Figure 3A:
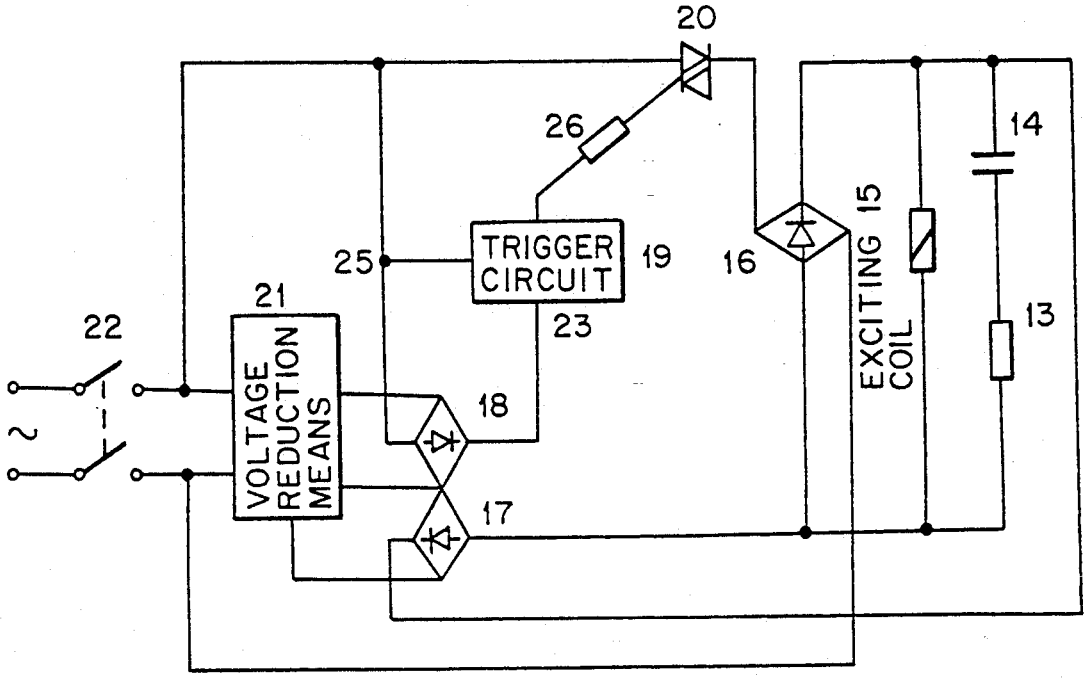
FIG. 3A is a schematic diagram of the excitation system of the third embodiment of the electromagnet according to the present invention.

FIG. 3A illustrates a schematic diagram of an electromagnet excitation system according to the present invention as the third embodiment. The system comprises a power source switch 22, an exciting coil 15 and a resistance-capacitance absorbing network 13 and 14 connected in parallel therewith, as well as a controllable power source means. The AC terminals of an initiation power source is controlled by the use of a thyristor 20 as a control switch and the voltage of the source is full-wave rectified by a rectification bridge 16. The AC terminals of the bridge 16 are connected to the control terminals of the power source switch 22 after having been connected in series with the thyristor 20. The holding power source voltage is generated by the use of a voltage reduction means 21 whose high voltage terminals is connected to the control terminals of the switch 22 and is full-wave rectified by a rectification bridge 17. The AC terminals of the rectification bridges 17 and 18 may be connected to respective output terminals at the low voltage side. The DC output terminals of the bridge 17 of the holding power source are connected to the exciting coil 15 after having been connected in parallel with the DC output terminals of the rectification bridge 16 of the initiation power source. The positive and negative input terminals (23 and 25) of the initiation trigger circuit 19 of the thyristor 20 are respectively connected to the positive and negative output terminals of the rectification bridge 18 of the trigger circuit 19; a signal of the output terminal 24 of the initiation trigger circuit 19 triggers the bidirectional thyristor 20.

The input signal of real-time triggering is received by the trigger circuit 19 via the positive and negative terminals 23 and 25 at the instant of closing the power source switch 22, thereby triggering the thyristor 20 in real time. A trigger pulse, having its front edge as steep as that of the instantaneous closing voltage mentioned above (approximating a step) and its pulse width or pulse triggering effect width adjustable, can be generated by the initiation trigger circuit 19, such as differential peaky pulse, differential peaky pulse with steepened trailing edge, square pulse, and approximately square pulse. These pulses trigger the thyristor with voltage or level triggering mode, such that the conducting duration of the thyristor is determined by the pulse width or effective pulse width. The thyristor is cut off in the initiation procedure of the electromagnet EM before the armature 1 arrives at the final position of its movement and converts to exciting power supplied by the DC terminals of the rectification bridge 17 of the holding power source immediately. Therefore, the impact of the armature against the iron core can be reduced. When the initiation time and reliability are affected by the variations of the loads during the procedure of initiation of the electromagnet, such variations of the loads can also be adapted by adjusting the conducting duration of the thyristor, so as to make the initiation more reliable and responsive.

The signal output terminal 24 of the above mentioned trigger circuit 19 may be directly connected to the trigger electrode of the thyristor or connected to this electrode via a voltage-dividing resistor 26. The rectification bridge 18 may directly drive the trigger circuit 19 or drive this circuit after further filtration and stabilization of voltage. The voltage reduction function of the voltage reduction means 21 may be implemented in many ways, such as transformer, resistance-capacitance voltage reduction, inductor voltage reduction, voltage reduction by pulse width regulation, and voltage reduction by thyristor phase shift trigger. Thyristor 20 may be a bidirectional transistor as shown or two unidirectional thyristors inversely connected in parallel. However, the thyristors always lead the network AC current to be full-wave rectified by the rectification bridge 16 through the switch 22 and triggered by the signal beginning from the closing of the switch 22, i.e., the level of a generated width adjustable pulse. For unidirectional thyristors, the trigger pulse of positive voltage is applied to the trigger electrode; while for bidirectional thyristors, the trigger pulse of positive voltage can also be applied to the cathode, i.e., the negative terminal 25 and the output terminal 24 may be connected interchangeably. In order to protect the trigger electrode, a clamping diode or stabilivolt or shunt resistance may be connected in parallel between the trigger electrode and the cathode. The resistor 26 may be a diode.

Figure 3B:
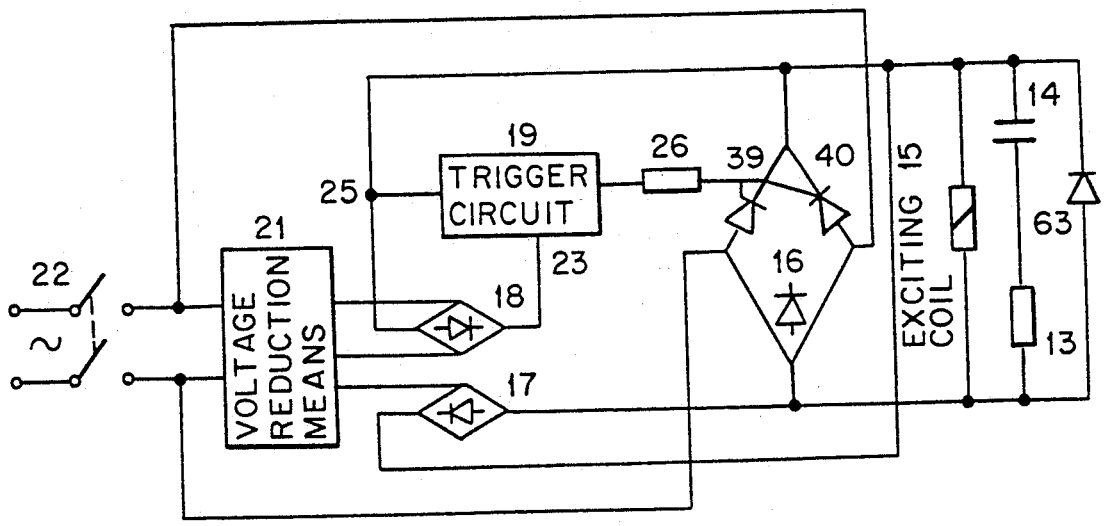
FIG. 3B is another diagram similar to that of FIG. 3A showing the excitation system of the fourth embodiment of the electromagnet according to the present invention.

FIG. 3B illustrates a schematic diagram similar to the diagram of FIG. 3A. The difference is that the thyristors are two unidirectional thyristors 39 and 40 as two arms of the initiation power source bridge 16, and there is a continuing current diode 63 connected in parallel with the coil 15.

Figure 4A:
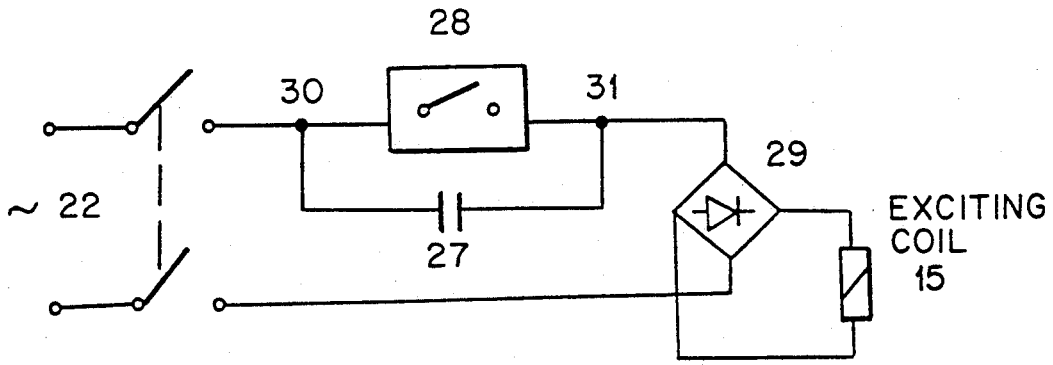
FIG. 4A is a schematic diagram of an excitation system showing the parallel connection of the double power source converting switch with the voltage reduction capacitor and their connection to a common rectification bridge.

FIG. 4A is a schematic diagram showing another double power source excitation system for the electromagnet. A control switch 28 of the controllable power source means CS is connected in series with the AC terminals of the rectification bridge 29 shared by initiation and holding after having been connected in parallel with a voltage reduction capacitor 27 at parallel junctions 30 and 31. When the power source switch 22 is closed, the network's AC current is supplied to the AC terminals of the rectification bridge 29 through the closed control switch 28; when the control switch 28 is turned off, the network's AC current is supplied to the AC terminals of the rectification bridge 29 after the voltage reduction by capacitor 27.

The control switch 28 can be an electronic switch, such as bidirectional thyristor or unidirectional thyristors inversely connected in parallel, in the manner of full phase angle conduction triggering, or a mechanical switch, such as a pair of normal close contacts. The control switch 28 is turned on at the instant of the closing of the switch 22, but its time of turning off is adjustable. The time during which the switch 28 is operating is the duration of the power supply by the initiation power source, while there is nearly no current passing through the voltage reduction capacitor due to the short circuit effect of the switch 28. The DC terminals of the rectification bridge 29 are connected to the exciting coil 15.

Figure 4B:
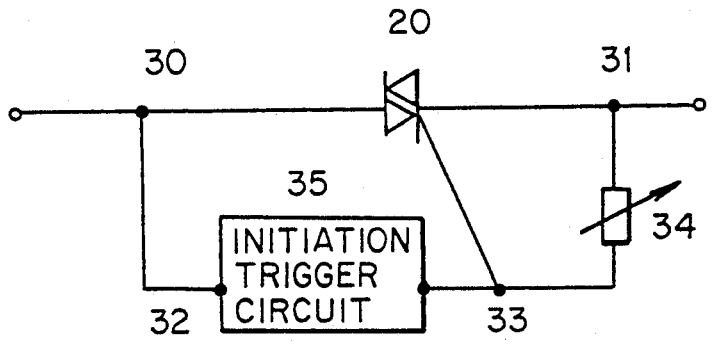
FIGS. 4B–4E show the circuitries of the fifth, sixth, seventh and eighth embodiments according to the present invention based on the circuitry shown in FIG. 4A.

FIG. 4B illustrates the fifth embodiment embodying the principle of FIG. 4A, what is shown in the Figure are merely the components of the control switch 28. A bidirectional thyristor 20 as an electronic switch is connected in parallel. A variable resistance 34 for adjusting the triggering current and thereby adjusting the effective trigger width of the triggering pulse output by the initiation trigger circuit 35 is connected in parallel between the trigger electrode and the cathode of thyristor 20. The front edge of the triggering pulse generated by the initiation trigger circuit 35 is as steep as that of the instantaneous voltage at the instant of closing and without being affected by the polarity of the instantaneous voltage at the instant of closing, thereby, the real time triggering characteristic can be realized. The terminals 32 and 33 of the trigger circuit may be connected to the anode and trigger electrode of thyristor 20, and can be connected interchangeably.

A clamping diode or stabilivolt or resistance can also be connected in parallel between the cathode and trigger electrode of the thyristor 20 thereby to protect the trigger electrode. With appropriate parameters being used in a specific situation, the variable resistance may also be eliminated. In addition, a current-limiting resistance can be connected in series with the trigger electrode for limiting the trigger electrode current.

Figure 4C:
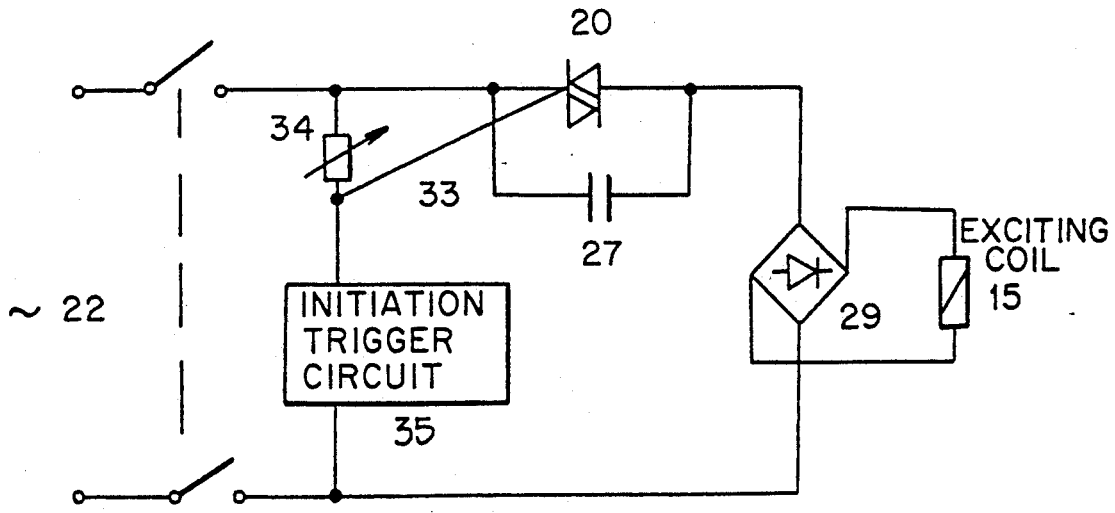

FIG. 4C is a modification of FIG. 4B illustrating the sixth embodiment of the present invention, the purpose of which is to prevent the operation of the trigger circuit 35 from the influence of the load (coil 15). One terminal of the initiation trigger circuit 35 is connected to the trigger electrode, while the other terminal is connected to a control terminal of the power source switch 22 of the electromagnet, instead of being connected to the anode of the bidirectional thyristor 20. The cathode of the thyristor is connected to the other control terminal of the switch 22.

Figure 4D:
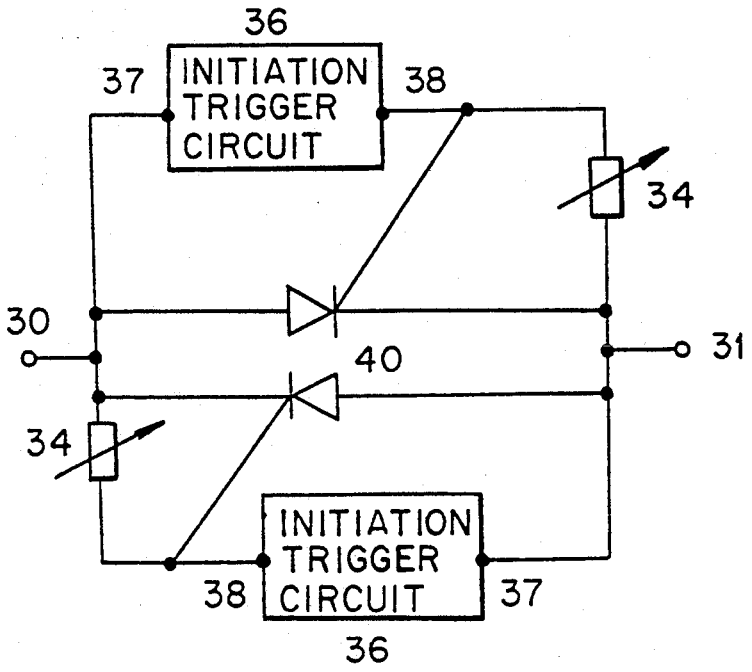

FIG. 4D shows the seventh embodiment of the present invention. The bidirectional thyristor in FIG. 4B is replaced by two unidirectional thyristors 39 and 40 connected inversely and parallelly, the purpose of which is to avoid the problem of unreliable cutting off possibly generated by the bidirectional thyristor. The resistance-capacitance absorbing network 13 and 14 shown in FIG. 1 have to be connected in parallel with the coil 15 when the unidirectional thyristors 39 and 40 have been used. Again, only the above mentioned control switch 28 portion is illustrated in FIG. 4D, wherein the initiation trigger circuit 36 connected in parallel between the anode and trigger electrode of each of the thyristors 39 and 40 are operative to ensure the real time characteristic of the above mentioned triggering.

Figure 4E:
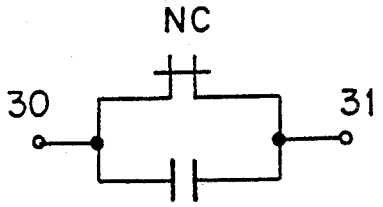

FIG. 4E is the eighth embodiment embodying the principle of FIG. 4A, wherein the above mentioned switch 28 is a pair of normal close contacts NC controlled by a mechanism driven by the electromagnet EM. The normal close contacts NC are closed at the time of the reset of the armature 1 and separated in the initiation procedure of the electromagnet before the armature 1 arrives at the final position of its movement. The time of separation of the contacts NC can be adjusted by the help of the mechanism.

Figure 5A:
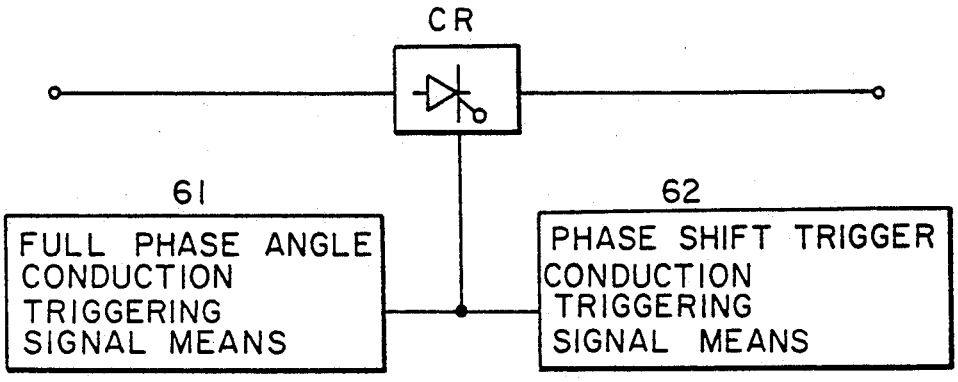
FIG. 5A is a schematic diagram of an excitation system energized by full phase angle triggering for initiation and by phase shift triggering for holding.

FIG. 5A is a diagram showing a design in which the initiation and holding power sources share a common rectification bridge, and the control switch of the controllable power source means CS is at least a thyristor CR. The thyristor CR is triggered to energize the initiation and holding states of the electromagnet respectively by the use of means 61 for generating a full phase angle conduction triggering signal and means 62 for generating a phase shift trigger conduction triggering signal. The means 61 or the means 62 may also be a computer or a circuit.

FIGS. 5B–5E illustrate the ninth, tenth, eleventh and twelfth embodiments according to the principle of FIG. 5A, wherein the means 61 for generating the full phase angle conduction triggering signal is respectively the trigger circuits 35 and 36A and the means 62 for generating the phase shift trigger conduction triggering signal is a phase shift trigger circuit 41 which is any phase shift trigger circuit designed to employ power source synchronization, such as well matured phase shift trigger circuit and phase trigger circuit of uni-junction transistor.

Figure 5B:
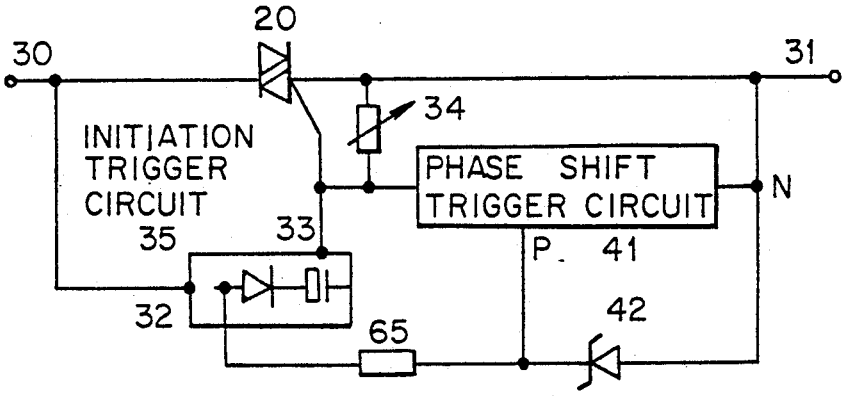
FIGS. 5B–5E are schematic diagram illustrating the ninth, tenth, eleventh and twelfth embodiments according to the present invention based on the circuitry shown in FIG. 5A.

In FIG. 5B, the two terminals 32 and 33 of the trigger circuit 35 are connected respectively to the anode and trigger electrode of the bidirectional thyristor 20. The negative terminal N of the phase shift trigger circuit 41 is connected to the cathode of the thyristor 20, its positive terminal P to the anode of the diode or the capacitor through a resistor 65 in the branch in which the current flows from the terminal 32 to the terminal 33 in the trigger circuit 35, and its output terminal 0 is connected to the trigger electrode of the thyristor 20. The positive and negative terminals P and N of the phase shift trigger circuit 41 may also be respectively connected to the positive and negative electrodes of a stabilivolt diode 42.

Figure 5C:
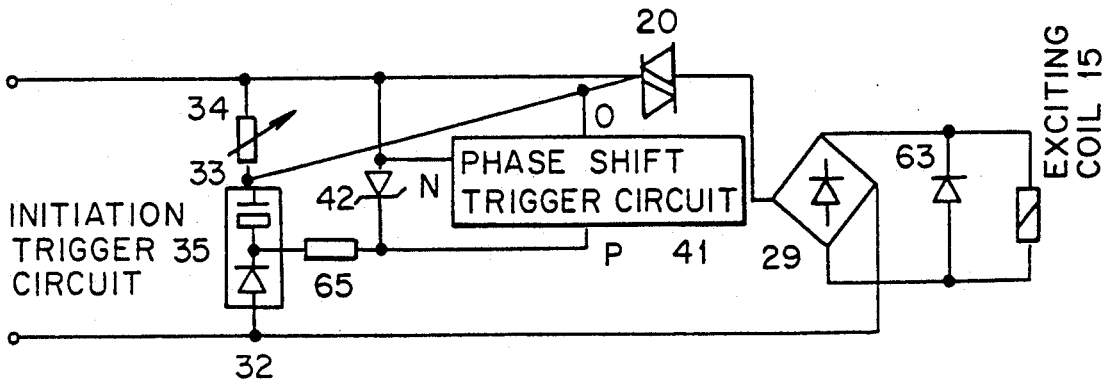

The difference of the design of FIG. 5C from that of FIG. 5B is similar to the difference of the design of FIG. 4C from that of FIG. 4B, namely, the terminal 32 is connected to the other control terminal of the switch 22, i.e., the other terminal of the AC terminals of the bridge 29. The rest of FIG. 5C is the same as that of FIG. 5B.

Figure 5D:
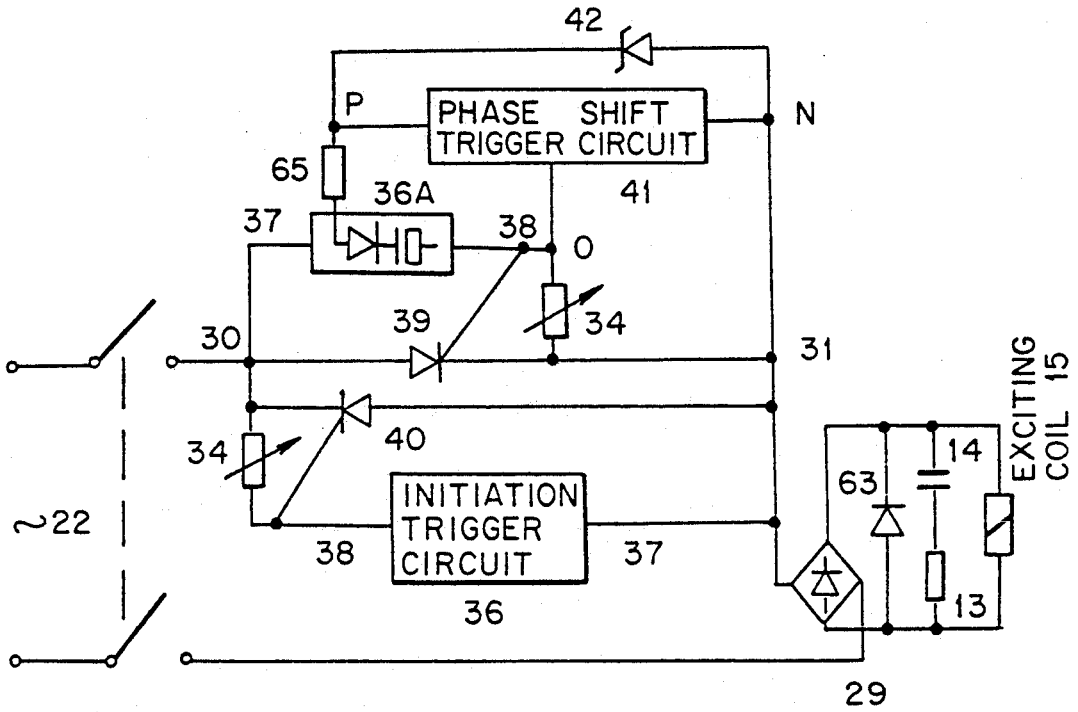

The designs of FIGS. 5B, 5C and 5D are based on the designs of FIGS. 4B, 4C and 4D. The voltage reduction capacitor 27 in FIGS. 4C and 4E is eliminated and the voltage reduction is realized by the use of the thyristor phase shift trigger 41.

When the initiation trigger circuit 36 is used in the design of FIG. 5D, the circuit 36 must be the same as the circuit 36A. In this case, the method of connecting the circuit 41 with the circuit 36A and the thyristor is similar to that of FIG. 5B or FIG. 5C, i.e., the positive terminal 37 of the circuit 36A is connected to the anode of one of the unidirectional thyristors 39 and 40 and the negative terminal 38 is connected to the trigger electrode of the same thyristor. The negative terminal N of the circuit 41 is connected to the cathode of one of the thyristors 39 and 40, its positive terminal P to the anode of the capacitor or the diode in the circuit 36A through a resistor 65 and its output terminal 0 to the trigger electrode of the same thyristor. The stabilivolt diode 42 is connected in the circuit as shown in FIG. 5B.

In the design of FIG. 5D, the exciting coil 15 is connected in parallel to a resistance-capacitance absorbing network constituted by a resistor 13 and a capacitor 14 for protecting the unidirectional thyristors.

There could be two designs in FIG. 5D. One is to use two phase shift trigger circuits 41 with stabilivolt diodes 42, and the other is to use one shift phase trigger circuit 41 with the diode 42 in one of two unidirectional thyristor branches. Sometimes the diode(s) 42 can also be eliminated.

Figure 5E:
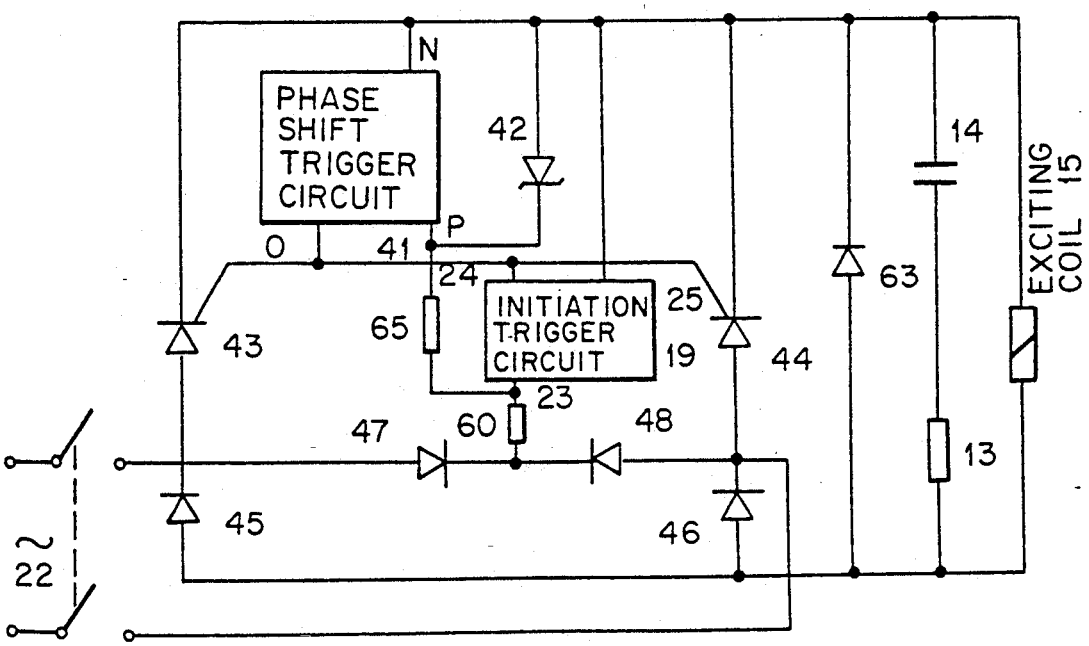

FIG. 5E differs from FIGS. 5B–5D in that the control switch unidirectional thyristors 43 and 44 of the initiation power source are the two bridge arms of the rectification bridge. These two thyristors 43 and 44 together with two diodes 45 and 46 constitute a full wave rectification bridge; other two diodes 47 and 48 with the two diodes 45 and 46 constitute another full wave rectification bridge. The two rectification bridges have their common AC input terminals connected to the control terminals of the power source switch 22. Both trigger electrodes of the two thyristors 43 and 44 are connected together to the output terminal 0 of the phase shift trigger circuit 41 and the output terminal 24 of the initiation trigger circuit 19, while both of their cathodes are connected together to the negative terminal N of the phase shift trigger circuit 41 and the input terminal 25 of the initiation trigger circuit 19. The positive output terminal of the other full wave rectification bridge is connected to the positive input terminal 23 of the initiation trigger circuit 19 through a voltage reduction resistor 60, and the positive terminal P of the phase shift trigger circuit 41 is also connected to the terminal 23 through a resistor 65 and the two terminals of the exciting coil 15 are connected to a resistance-capacitance absorbing network consisting of the resistor 13 and the capacitor 14. The stabilivolt diode 42 is connected between the positive and negative terminals P and N of the circuit 41. A continuing current diode 63 is connected in parallel to the coil in the phase shift trigger voltage reduction scheme, since the load current of the pulsing component is rather large.

The above mentioned resistor 65 and even the stabilivolt diode 42 can also be eliminated in the above mentioned embodiments.

Figure 6A:
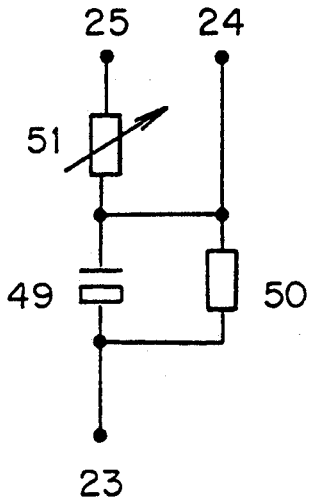
FIGS. 6A–6F are diagrams showing the initiation trigger circuits of the thirteenth to eighteenth embodiments.

FIGS. 6A–6F show embodiments of all the above mentioned initiation trigger circuits. FIGS. 6A–6D show four embodiments of the circuit 19. The thirteenth embodiment of FIG. 6A is a differential circuit with a variable resistor 51. A capacitor 49 with its parallelly connected discharging resistor 50 and the variable resistor 51 are successively connected in series through a series junction between the positive and negative input terminals 23 and 25 of the circuit 19 and an output terminal 24 is tapped at the series junction. The input terminal 23 receives the front edge signal of the step voltage at the instant of closing to perform real-time trigger initiation. The DC voltage signal then charges capacitor 49 until the output current of the output terminal 24 is insufficient to trigger the thyristor, and the initiation trigger operation is ended. The resistor 50 should be as high as not sufficient to cause false trigger, but it should not be too low either, such that when the excitation system of the electromagnet is de-electrified, it discharges at once without affecting the next initiation. The variable resistor 51 is operative to adjust the trigger current, so as to adjust, in turn, the effective pulse width for triggering.

Figure 6B:
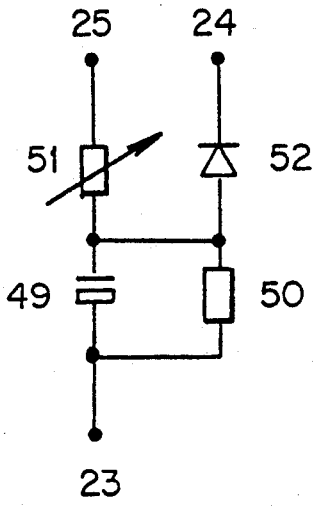

The object of the fourteenth embodiment of FIG. 6B is to steepen the trailing edge of the trigger pulse produced by the circuit of the thirteenth embodiment to make the cut-off of the thyristor more accurate by means of using a diode 52 connected to the output terminal 24. Of course, two diodes connected in series can also be employed.

Figure 6C:
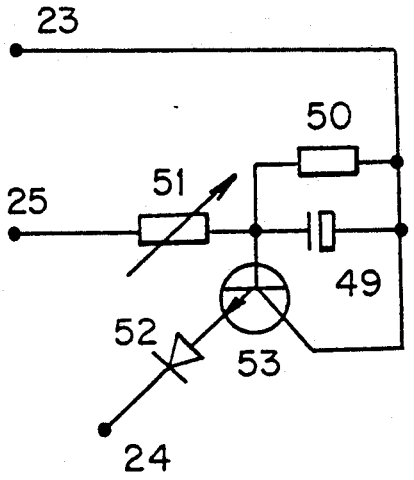

The object of the fifteenth embodiment of FIG. 6C is to produce an approximately square wave triggering pulse by the use of a switch transistor 53 and trailing edge trimming diode 52. A capacitor 49 with its parallelly connected discharging resistor 50 and a variable resistor 51 are successively connected in series through a series junction between the positive and negative input terminal 23 and 25 of the initiation trigger circuit 19. A series circuit constituted by the base emitter p-n junction of the transistor 53 and the diode 52 is connected between the series junction and the output terminal 24, and the collector of the transistor 53 is connected to the positive input terminal 23.

Figure 6D:
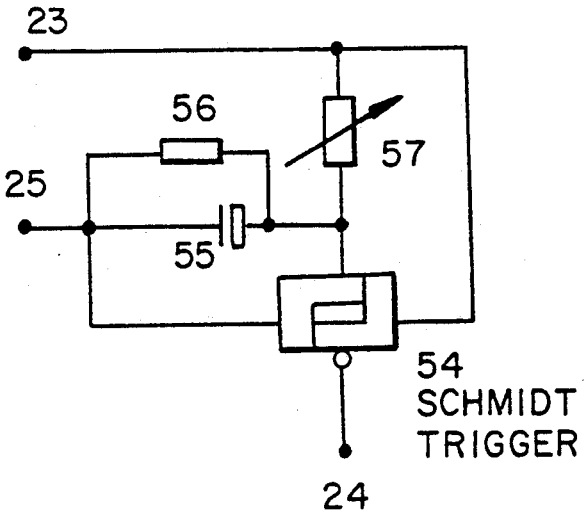

The object of the sixteenth embodiment of FIG. 6D is to produce a square wave triggering pulse by the use of a Schmidt trigger 54 of an integrating circuit at the input of the trigger. A variable resistor 57 and a capacitor 55 with its discharging resistor 56 are connected successively in series through a series junction between the positive and negative input terminals 23 and 25 of the circuit 19. The series junction is connected to the input terminal of the Schmidt trigger 54. The positive and negative electrodes of the trigger 54 are connected to the positive and negative input terminals 23 and 25 respectively and the output terminal of the trigger 54 is the output terminal 24 of the initiation trigger circuit 19. The inverse effect of the trigger makes the front edge of the triggering square pulse to be generated at the instant of closing.

Figure 6E:
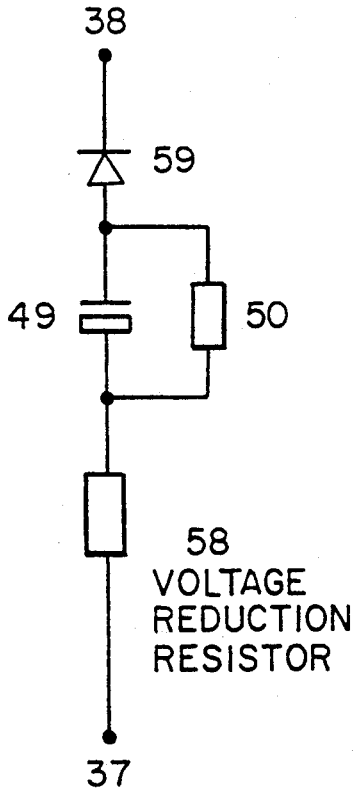
Figure 6F:
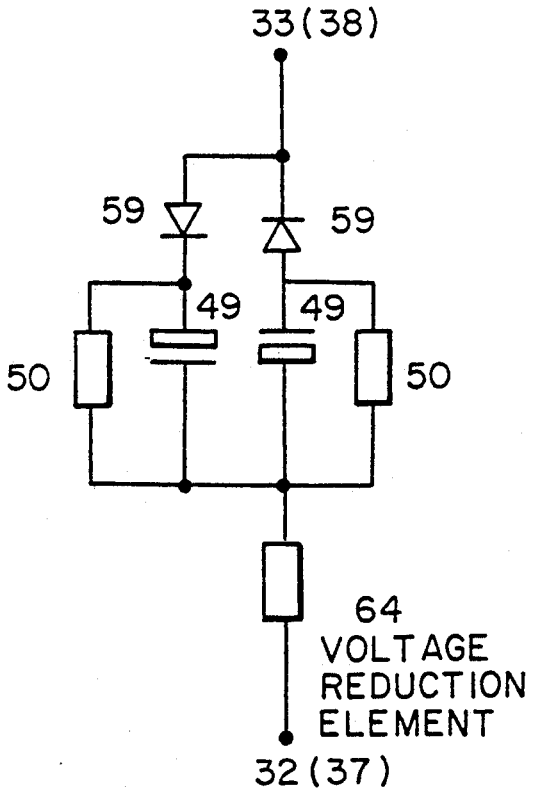

FIGS. 6E and 6F as the seventh and eighteenth embodiments illustrate the structures of the initiation trigger circuits 36 and 35. A voltage reduction resistor 58, a diode 59 and a capacitor 49 with its parallelly connected discharging resistor 50 are connected in series between the positive and negative terminals 37 and 38 of the circuit 36. The positive-negative direction of the diode 59 is the same as the positive-negative direction of the terminals 37 and 38. The positions of the three elements connected in series are interchangeable, wherein the scheme of connecting resistor 58 with the terminal 37 is defined as the initiation trigger circuit 36A. As shown in FIG. 6F, a voltage reduction element 64 and a network constituted by two parallel and inversely connected identical branches are connected in series between the two terminals 32 and 33 of the circuit 35. Each of the parallel branches comprises a diode 59 and a capacitor 49 with its parallelly connected discharging resistor 50 connected in series. Here the voltage reduction element 64 may be a resistor, a capacitor or a series resistance-capacitance unit because of double-direction current flowing in the circuit 35.

What is claimed is:

1. An electromagnet comprising an electromagnetic body including an armature and an iron core between which there is no demagnetizing air gap when the electromagnet is in a holding state; a DC excitation system including an exciting coil and a controllable power source means; and an energy storage means applied to the electromagnetic body, said energy storage means being stored with mechanical energy in the holding state of the electromagnet, which forms an action force on said iron core from said armature as well as a reaction force on said armature from said iron core, the action line of the resultant of said reaction force being non-collinear with the action line of the resultant of a holding force, the resultant force of the reaction force thereby generating a momentary rotation force on the armature so as to cause the armature to make a slight rotation permissible by the structure of the electromagnetic body relative to said iron core after the exciting coil is de-electrified; wherein said controllable power source means comprises an initiation power source and a holding power source of different voltages, and a control switch for real-time turning on said initiation power source and converting said initiation power source to said holding power source, said initiation power source and said holding power source respectively employing full bridge rectification to energize said exciting coil.

2. The electromagnet according to claim 1, wherein said energy storage means is a spring energy storage means having a spring, an adjusting screw, and a ball, said ball applying the action force on said iron core acted by said spring when the electromagnet is in the holding state and the magnitude of said momentary rotation force can be changed by the adjusting screw.

3. The electromagnet according to claim 1, wherein said energy storage means is a reset means of said armature in a loading system.

4. The electromagnet according to claim 1, wherein said electromagnet comprises a dirt protecting cover.

5. The electromagnet according to claim 1, wherein said controllable power source means further comprises a voltage reduction means having its high voltage side connected in parallel with the AC input terminals, which are connected in series with a thyristor, of the rectification bridge of said initiation power source and connected to the controlled terminals of a power source switch and a trigger circuit for the thyristor, including a third rectification bridge, the AC terminals of said rectification bridge of said holding power source and the third rectification bridge being connected to the low voltage side of said voltage reduction means, the DC output terminals of the rectification bridge of said holding power source and the DC output terminals of the rectification bridge of said initiation power source being connected in parallel and then connected to said exciting coil, two input terminals of said trigger circuit of said thyristor being connected to the DC output terminals of the third rectification bridge whereby a signal from the output terminal of said trigger circuit will trigger said thyristor.

6. The electromagnet according to claim 1, wherein said controllable power source means further comprises a voltage reduction means and two unidirectional thyristors replacing two arms of said rectification bridge of said initiation power source, wherein the AC input terminals of the rectification bridge of said initiation power source are connected in parallel with the high voltage side of said voltage reduction means and connected to the control terminals of a power source switch; and a trigger circuit for the thyristors, including a third rectification bridge, the AC terminals of the rectification bridge of the holding power source and the third rectification bridge being connected to the lower voltage side of said voltage reduction means, the DC output terminals of the rectification bridge of said holding power source being connected in parallel with the DC output terminals of the rectification bridge of said initiation power source and connected to said exciting coil, two input terminals of the trigger circuit of said thyristors being connected to the DC output terminals of the third rectification bridge, whereby a signal from the output terminal of said trigger circuit will trigger said unidirectional thyristors.

7. The electromagnet according to claim 1, wherein the control switch of said controllable power source means is connected in series with the AC terminals of the rectification bridge shared by the initiation power source and the holding power source, the control switch being connected in parallel with a voltage reduction capacitor, the DC terminals of said rectification bridge being connected to said exciting coil.

8. The electromagnet according to claim 7, wherein said control switch is a bidirectional thyristor with an initiation trigger circuit connected between the anode and the trigger electrode thereof.

9. The electromagnet according to claim 7, wherein said control switch is a bidirectional thyristor, an initiation trigger circuit being connected between the trigger electrode of said bidirectional thyristor and a controlled terminal of a power source switch.

10. The electromagnet according to claim 7, wherein said control switch comprises two parallel and inversely connected unidirectional thyristors; two initiation trigger circuits with their positive terminals respectively connected to the corresponding anodes of said thyristors and with their negative terminals connected to respective trigger electrodes of said thyristors; and an absorbing network constituted by a resistor and a capacitor being connected to the two terminals of said exciting coil.

11. The electromagnet according to claim 7, wherein said control switch comprises a pair of normal-closed contacts controlled by a mechanism driven by said electromagnet, said pair of normal-closed contacts being closed at the time of reset of said armature, and separated during an initiation procedure of the electromagnet until said armature arrives at its ultimate displacement position.

12. The electromagnet according to claim 1, wherein said initiation and holding power sources have a common rectification bridge, and the control switch of said controllable power source means is a thyristor which is triggered to thereby energize the electromagnet in its initiation and holding stage through means for generating full phase angle conduction triggering signal and means for generating phase shift trigger conduction triggering signal.

13. The electromagnet according to claim 12, wherein said thyristor is a bidirectional thyristor; said means for generating full phase angle conduction triggering signal is a trigger circuit having a terminal connected to the anode of said bidirectional thyristor and another terminal connected to the trigger electrode of the thyristor; said means for generating phase shift trigger conduction triggering signal is a phase shift trigger circuit having a negative terminal connected to the cathode of said thyristor, a positive terminal connected to the anode of a diode in the trigger circuit through a resistor in a branch through which the trigger circuit flows from a voltage reduction means to said trigger circuit, and an output terminal connected to the trigger electrode of said thyristor.

14. The electromagnet according to claim 12, wherein said thyristor is a bidirectional thyristor; said means for generating full phase angle conduction triggering signal is a trigger circuit with a terminal connected to the trigger electrode of said bidirectional thyristor and another terminal connected to one of AC terminals of the common rectification bridge, the anode of said bidirectional thyristor being connected to the other AC terminal of the common rectification bridge; said means means for generating phase shift trigger conduction triggering signal is a phase shift trigger circuit with a negative terminal connected to the cathode of said thyristor, a positive terminal connected to the anode of a capacitor in the trigger circuit through a resistor in a branch through which the trigger current flows from a voltage reduction means to said trigger circuit, and an output terminal connected to the trigger electrode of said thyristor.

15. The electromagnet according to claim 12, wherein said thyristor comprises two parallel and inversely connected unidirectional thyristors; said means for generating full phase angle conduction triggering signal is an initiation trigger circuit with its positive terminal connected to the anode of one of said unidirectional thyristors and its negative terminal connected to the trigger electrode of said one thyristor, the two terminals of said initiation trigger circuit being connected to the anode and trigger electrode of another unidirectional thyristor respectively; means for generating phase shift trigger conduction triggering signal is a phase shift trigger circuit with its negative terminal connected to the cathode of said one unidirectional thyristor, its positive terminal connected to the anode of a diode in the initiation trigger circuit through a resistor, and its output terminal connected to the trigger electrode of said one unidirectional thyristor; and said exciting coil is connected in parallel to an absorbing network including a resistor and a capacitor.

16. The electromagnet according to claim 12, wherein said thyristor comprises two parallel and inversely connected unidirectional thyristors; said means for generating full phase angle conduction triggering signal comprises two initiation trigger circuits with their positive and negative terminals connected respectively to the anode and trigger electrode of the corresponding one of said unidirectional thyristors; means for generating phase shift trigger conduction triggering signal comprises two phase shift trigger circuits with their negative terminals respectively connected to the cathode of the corresponding one of said unidirectional thyristors, their positive terminals respectively connected through a resistor to the anode of a diode in the corresponding one of said initiation trigger circuits, and with their output terminals respectively connected to the trigger electrode of the corresponding one of said unidirectional thyristors; and said exciting coil is connected in parallel to an absorbing network including a resistor and a capacitor.

17. The electromagnet according to claim 12, wherein said thyristor comprises two unidirectional thyristors constituting with two diodes a full wave rectification bridge, said two diodes constituting with other two diodes another full wave rectification bridge, said two rectification bridges having common AC input terminals connected to the controlled terminal of a power source switch, said two thyristors having their trigger electrodes connected together to the output terminal of a phase shift trigger circuit and the output terminal of an initiation trigger circuit and having their cathodes connected together to the negative terminal of said phase shift trigger circuit and the output terminal of said initiation trigger circuit, the positive output terminal of one of said full wave rectification bridges and the positive terminal of said phase shift trigger circuit being connected to the positive terminal of said initiation trigger circuit through a voltage reduction resistor and another resistor respectively, and said exciting coil being connected in parallel to an absorbing network including a resistor, a capacitor, and a diode.

18. The electromagnet according to claim 8, 9, 10, 12, 13, 14, 15, or 16, wherein a variable resistor is connected between the cathode and the trigger electrode of said thyristor.

19. The electromagnet according to claim 13, 14, 15, 16 or 17, wherein a stabilivolt diode is connected between the positive and negative terminals of the phase shift trigger circuit.

20. The electromagnet according to claim 5, 6 or 16, wherein a capacitor is first connected in parallel with a discharging resistor and successfully connected at a series junction with a variable resistor in series between the positive and negative input terminals of said initiation trigger circuit, and an output terminal of said initiation trigger circuit being tapped at said series junction.

21. The electromagnet according to claim 19, wherein said output terminal of the initiation trigger circuit is connected through a diode at said series junction.

22. The electromagnet according to claim 19, wherein a series circuit constituted by the base-emitter p-n junction of a transistor and a diode is connected between said series junction and the output terminal, and the collector of said transistor being connected to said positive input terminal.

23. The electromagnet according to claim 5, 6 or 16, wherein a variable resistor and a capacitor with a parallel discharging resistor are connected successively through a series junction between the positive and negative input terminals of said initiation trigger circuit, said series junction being connected to the input terminal of a schmidt trigger with its positive and negative electrodes connected to the positive and negative input terminals of said initiation trigger circuit respectively and with its output terminal constituting the output terminal of said initiation trigger circuit.

24. The electromagnet according to claim 10, 15 or 16, wherein a voltage reduction resistor, a diode and a capacitor with a parallel discharging resistor are connected in series between the positive and negative terminal of said initiation trigger circuit.

25. The electromagnet according to claim 8, 9, 13 or 14, wherein a voltage reduction element and a network constituted by two parallel and inversely connected identical branches are connected in series between the two terminals of said initiation trigger circuit, each of said parallel branches comprising a diode and a capacitor with a parallel discharging resistor connected in series.

26. The electromagnet according to claim 25, wherein said voltage reduction element is a resistor.

27. The electromagnet according to claim 25, wherein said voltage reduction element is a capacitor.

28. The electromagnet according to claim 25, wherein said voltage reduction element is a series of a resistor and a capacitor.

* * * * *